US008215386B2

(12) United States Patent
Manke et al.

(10) Patent No.: US 8,215,386 B2
(45) Date of Patent: Jul. 10, 2012

(54) DOWNHOLE TOOL RELEASING MECHANISM

(75) Inventors: Kevin R. Manke, Marlow, OK (US); Tracy M. Martin, Spring, TX (US); Robert Preston Clayton, Comanche, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 284 days.

(21) Appl. No.: 12/652,933

(22) Filed: Jan. 6, 2010

(65) Prior Publication Data

US 2011/0163560 A1 Jul. 7, 2011

(51) Int. Cl.
*E21B 17/02* (2006.01)
*E21B 17/06* (2006.01)

(52) U.S. Cl. ..... 166/242.7; 166/382

(58) Field of Classification Search ..... 166/382, 166/377, 242.6, 242.71; 285/2, 3, 4
See application file for complete search history.

(56) References Cited

U.S. PATENT DOCUMENTS

| | | | | |
|---|---|---|---|---|
| 2,872,238 | A | 2/1956 | Daffin | |
| 3,253,653 | A * | 5/1966 | Layne, Sr. | 166/63 |
| 3,960,399 | A | 6/1976 | Dufrene | |
| 4,071,084 | A * | 1/1978 | Brown et al. | 166/129 |
| 4,120,519 | A * | 10/1978 | Bridges | 285/3 |
| 4,232,888 | A | 11/1980 | Amancharla | |
| 4,373,753 | A * | 2/1983 | Ayers et al. | 285/319 |
| 4,441,559 | A | 4/1984 | Evans et al. | |
| 4,479,548 | A | 10/1984 | Gilbert | |
| 4,493,374 | A | 1/1985 | Magee, Jr. | |
| 4,532,989 | A | 8/1985 | Barker | |
| 4,548,437 | A | 10/1985 | Driskill | |
| 4,750,564 | A | 6/1988 | Pettigrew et al. | |
| 4,801,167 | A | 1/1989 | Driskill | |
| 4,834,184 | A | 5/1989 | Streich et al. | |
| 4,984,632 | A | 1/1991 | Sampa et al. | |
| 5,224,540 | A | 7/1993 | Streich et al. | |
| 5,271,468 | A | 12/1993 | Streich et al. | |
| 5,343,954 | A | 9/1994 | Bohlen et al. | |
| 5,404,956 | A | 4/1995 | Bohlen et al. | |
| 5,540,279 | A | 7/1996 | Branch et al. | |
| 5,701,959 | A | 12/1997 | Hushbeck et al. | |
| 5,839,515 | A | 11/1998 | Yuan et al. | |

(Continued)

FOREIGN PATENT DOCUMENTS

EP 1564413 A1 8/2005

OTHER PUBLICATIONS

International Search Report and Written Opinion of the International Searching Authority dated Nov. 7, 2011, in corresponding PCT Application PCT/GB2011/000011.

*Primary Examiner* — Cathleen Hutchins
(74) *Attorney, Agent, or Firm* — John W. Wustenberg; McAfee & Taft

(57) ABSTRACT

A downhole tool releasing mechanism which includes a collet for releasably engaging a mandrel of a downhole tool. A retaining band is circumferentially disposed about the fingers of the collet for maintaining engagement of the collet and the mandrel prior to application of a predetermined axially directed force on the releasing mechanism. Upon application of such a force the collet fingers expand, breaking the shear band, the mandrel is released and the downhole tool is disengaged.

20 Claims, 4 Drawing Sheets

U.S. PATENT DOCUMENTS

| | | | | |
|---|---|---|---|---|
| 5,984,007 | A | 11/1999 | Yuan et al. | |
| 6,167,963 | B1 | 1/2001 | McMahan et al. | |
| 6,394,180 | B1 | 5/2002 | Berscheidt et al. | |
| 6,491,116 | B2 | 12/2002 | Berscheidt et al. | |
| 6,695,057 | B2 | 2/2004 | Ingram et al. | |
| 6,708,770 | B2 | 3/2004 | Slup et al. | |
| 6,712,153 | B2 | 3/2004 | Turley et al. | |
| 7,048,066 | B2 | 5/2006 | Ringgenberg et al. | |
| 7,124,831 | B2 | 10/2006 | Turley et al. | |
| 7,350,582 | B2 | 4/2008 | McKeachnie et al. | |
| 7,434,627 | B2 | 10/2008 | Turley et al. | |
| 2003/0188860 | A1 | 10/2003 | Zimmerman et al. | |
| 2004/0045723 | A1* | 3/2004 | Slup et al. | 166/386 |
| 2006/0243434 | A1 | 11/2006 | Sharp et al. | |
| 2007/0051521 | A1 | 3/2007 | Fike et al. | |
| 2009/0044957 | A1 | 2/2009 | Clayton et al. | |

* cited by examiner

DOWNHOLE TOOL RELEASING MECHANISM

BACKGROUND

There are many circumstances that require a tool to be disconnected and left down hole in a well when services are performed downhole. In the past, various systems and mechanisms have been utilized to release downhole tools such as packers in different ways. Shear pins are often used to releasably connect tools, but in practical application shear pins can sometimes be unreliable due to quality control, variations in material strengths due to differing ages, batches and lots, disparate levels of service or maintenance, and other such difficulties which can result in premature release.

The current disclosure is directed to a mechanism for releasably connecting downhole tools which overcomes the drawbacks of the prior art as described above. The result is a more consistent, more predictable and more reliable mechanism for releasing downhole tools at the appropriate time. These and other advantages of the present invention will be more readily understood from a review of the various embodiments, drawings and associated description, below.

SUMMARY

The downhole tool releasing mechanism of the current disclosure includes a collet for engaging a mandrel of a downhole tool and a retaining band disposed about the collet. The retaining band will keep the collet engaged with the downhole tool until an axially directed force, or pull, of a predetermined amount is applied to the collet. Upon application of the predetermined axially directed force, or releasing force, the collet is released from the mandrel of the downhole tool. The collet can then move axially relative to the downhole tool and may be removed from the well.

In one embodiment, the collet includes a plurality of collet fingers, the retaining band is a shear band and the mandrel has buttress threads which slidably couple the collet fingers to the mandrel of the downhole tool, which may be, for example, a packer. Upon the packer being positioned at the desired depth or position, the collet and a setting sleeve work to move the packer to a set position by applying a setting force to the packer. Upon the application of a setting force, the packer will set and the collet fingers slide along the buttress threads of the packer mandrel, expanding the collet fingers until the shear band ruptures, disengaging the collet from the packer.

DESCRIPTION OF THE PREFERRED EMBODIMENT

Figure 1:
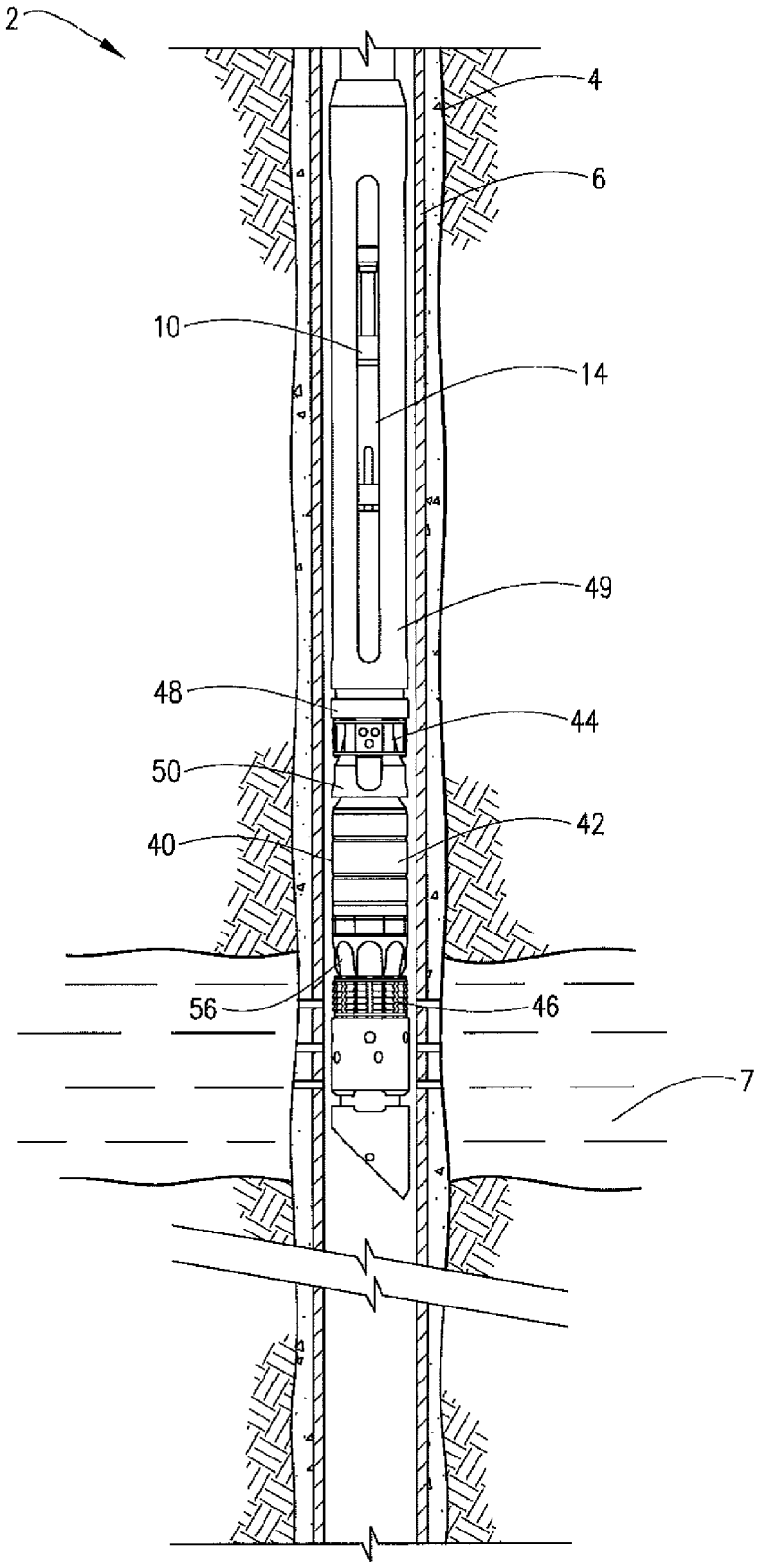
FIG. 1 is a cross section of a well showing the downhole tool disposed therein.

FIG. 1 shows a well 2 which comprises wellbore 4 with a casing 6 disposed therein and which may be cemented in wellbore 4. Generally, cementing of casing 6 fixes casing 6 to the wellbore 4 by filling the annulus between casing 6 and wellbore 4. Casing 6 and the cement in the annulus may be perforated to allow production of the oil or gas from a formation 7. A downhole tool 40, described in more detail below, may be lowered into well 2 with downhole tool releasing mechanism 10. Downhole tool releasing mechanism 10 may be connected to a setting tool on an upper end 11 thereof, and may be is releasably connected to downhole tool 40 at a lower end 12 thereof.

Downhole tool releasing mechanism 10 must have sufficient strength to prevent premature release or breakage as the downhole tool 40 is lowered into and positioned within the well 2 and moved to the set position.

Figure 2:
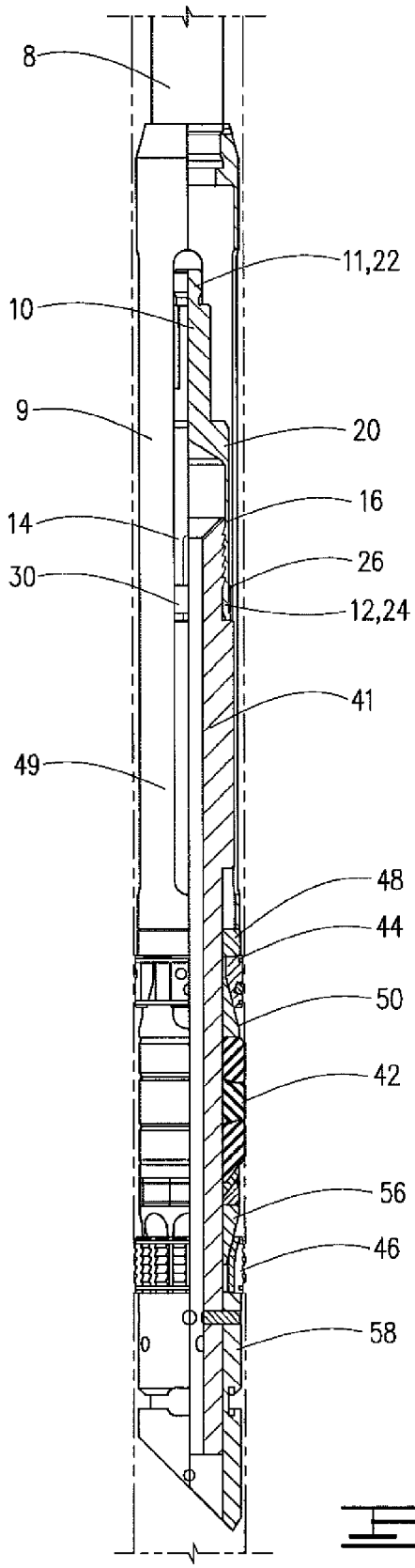
FIG. 2 is a partial section view of the present invention positioned in a well.
Figure 3:
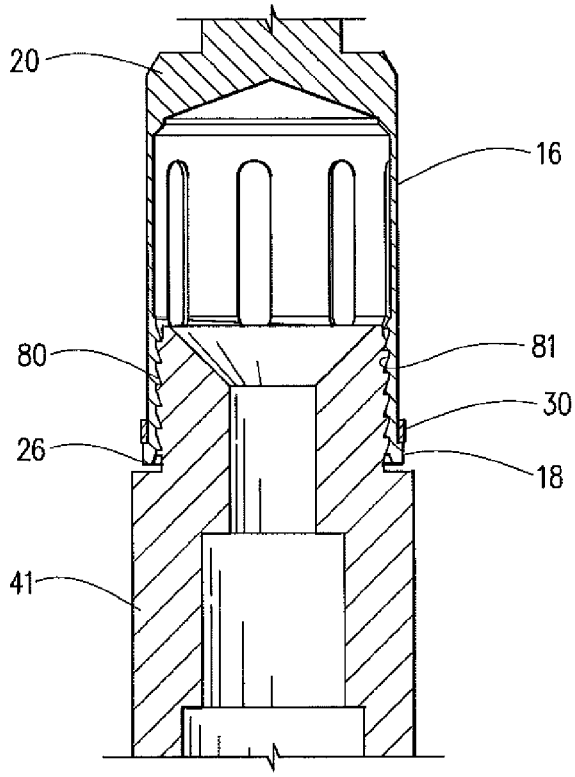
FIG. 3 is a section view of an embodiment of the invention.

Downhole tool releasing mechanism 10 may comprise a collet or adapter 14, as better shown in FIGS. 2 and 3. Collet 14 has a plurality of fingers 16 with collet heads 18 for releasably engaging downhole tool 40. Collet 14 has body portion 20 and fingers 16 extend from collet body 20. Collet 14 has upper end 22 and lower end 24. Collet heads 18 are at the lower end 24 of collet 14, which may be referred to as lower ends 26 of collet fingers 16.

In the embodiment shown in FIGS. 2 and 3, downhole tool releasing mechanism 10 also includes a retaining ring or shear band 30. Shear band 30 is circumferentially disposed about collet fingers 16 at, or near the lower ends 26 thereof for maintaining collet 14 in an engaged position with downhole tool 40. Shear band 30 may be a shearable metal band or may be at least partially flexible or elastomeric in nature, and further may be composed of a plurality of bands. Shear band 30 may likewise be one or more pieces. Critically, shear band 30 must permit the movement of collet fingers 16 relative to downhole tool 40 so that collet heads 18 disengage from downhole tool 40 upon application of a releasing force as described herein. The axial force, or pull required to disengage, which may be referred to as the releasing force, will generally be equal to or greater than the setting force required to move downhole tool 40 to the set position in the well.

In the current disclosure, downhole tool 40 is depicted as a packer, but releasing mechanism 10 may be used to connect to other components or tools, such as, for example, frac plugs or bridge plugs. The construction of packers is well known in the art, and therefore downhole tool 40 is presented in a simplified form in the present description. As depicted, downhole tool 40 comprises a mandrel 41 with sealing elements 42 disposed thereabout. Upper slip retainer 48, upper slips 44, lower slips 46, upper slip wedge 50, and lower slip wedge 56 are disposed about mandrel 41. A lowermost portion 58 may be, for example, a mule shoe, but can be any type of section that serves to terminate the structure of the tool or serves as a connector for other tools. Lowermost portion 58 is fixed to mandrel 41.

In order to move downhole tool 40 to the set position, a setting force must be applied. In the embodiment described, an axially directed upward force is applied by a setting tool to collet 14. Because collet 14 is engaged with mandrel 41, an axially directed upward force will be applied thereto with collet 14. Prior to tool 40 being moved to the set position, collet 14 is disposed in setting sleeve 49. Setting sleeve 49 abuts upper slip retainer 48 and will prevent the upward movement thereof. Thus, mandrel 41 will move upward relative to upper slip retainer 48. Lowermost portion 58 of downhole tool 40 is fixed to mandrel 41 so that upward movement of mandrel 41 will force upper and lower slips 44 and 46 to ramp outward via upper and lower slip wedges 50 and 56, and will cause compression of the sealing elements 42. Upon the engagement of upper and lower slips 44 and 46 with casing 6, additional upward axial force is applied to mandrel 41, which thus applies additional pressure to packing sealing elements 42, compressing the sealing elements 42. Sealing elements 42 will expand radially outwardly to engage and seal against the casing 6. Once a sufficient upward force has been applied to move downhole tool 40 to the set position, continued application of axial force will disengage collet 14 from mandrel 41. As explained herein, the axial force required to affect this release will be at or above the setting force, and may be referred to as a breaking, or releasing force.

A setting force can be applied to the downhole tool releasing mechanism 10 in a number of ways. Consequently, the present invention may be readily incorporated into a number of setting systems. In one embodiment, the upward pulling force can be provided by means of an explosive charge (not shown) actuated by an electric signal sent along a wireline to an igniter (not shown), and thus stroking a piston (not shown) to cause collet 14 to move. Alternate means of moving collet 14 exist and may be employed as known in the art, and are envisioned within the scope of the present invention.

In the embodiment shown in FIG. 3, mandrel 41 has buttress threads 80 disposed thereon, and collet fingers 16 have mating threads 81 to engage buttress threads 80. Shear band 30 will rupture as the threads 81 and collet heads 18 move over buttress threads 80.

Figure 4:
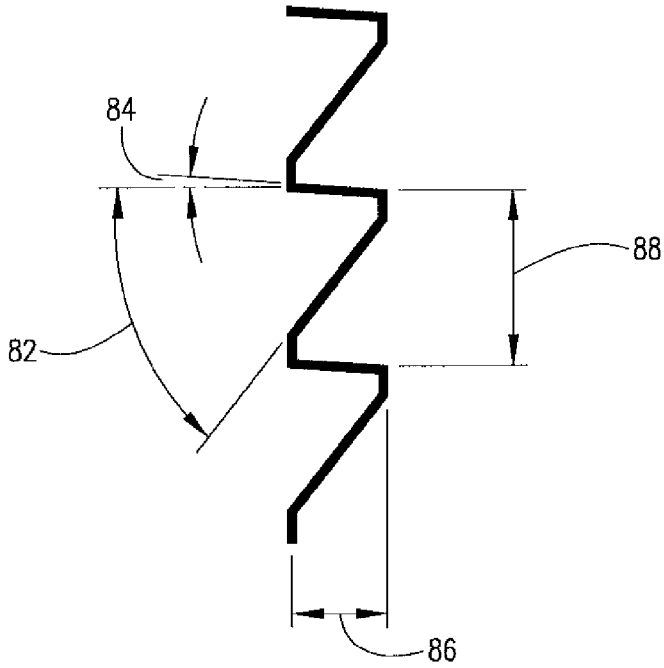
FIG. 4 is a detailed view of the buttress threads of the embodiment of FIG. 3.

In FIG. 4, buttress threads 80 are shown in greater detail. Buttress threads may be advantageous where there is a desire to increase the contact surface area and thus lower the stress seen at a discrete location when setting force is applied. Clearance flank angles 82 of buttress threads 80 should be greater than 45° and the pressure flank angles 84 should be less than 7° to ensure axially directed force is translated to outward force on shear band 30 through the engaged collet fingers 16. Additionally, the ratio of thread height 86 to thread pitch 88 should be less than 1:2 in order to prevent the application of excessive force to the collet heads 18. For the embodiment described, buttress threads 80 have clearance flank angles 82 of about 70° and pressure flank angles 84 of about 5°, and have a ratio of thread height 86 to thread pitch 88 of 1:4.

In operation, the downhole tool 40 and downhole tool releasing mechanism 10 are lowered into well 2. When downhole tool 40 reaches a desired location in the well, movement of the downhole tool 40 in the well is arrested. The setting tool is actuated by causing collet 14 to move axially upwardly. Setting sleeve 49 will not move relative to the well, and will abut upper slip retainer 48 to prevent upward movement thereof as previously described. The movement of mandrel 41 causes the upper slip retainer 48, upper slip wedge 50 and lower slip wedge 56 to compress the packer elements into sealing engagement with the well bore while upper slips 44 and lower slips 46 engage casing 6.

When the axial force applied to downhole tool releasing mechanism 10, and thus to collet 14, reaches the predetermined releasing force collet fingers 16 radially expand by sliding against the coupling surface of mandrel 41.

Prior to release, the radial expansion of collet fingers 16 is prevented, or at least limited by shear band 30, to keep collet 14 engaged with mandrel 41 until the releasing force is applied. As the axially directed force is applied to collet 14, a radially directed force is created via the interaction of mandrel 41 and collet fingers 16. The radially directed force of the collet fingers 16 increases with the additional axially directed force until the collet fingers 16 exert enough radially directed force to rupture shear band 30 and release the downhole releasing mechanism 10 from downhole tool 40. The radially directed force required to rupture shear band 30 will result from the application of a force that meets or exceeds the axial setting force of the tool. In one embodiment, the predetermined level of axial force may be about 25,000 lbs, but in any event is sufficient to ensure setting of downhole tool 40. The amount of force applied will vary, and will depend upon the design of the particular tool being set in the well.

Figure 5:
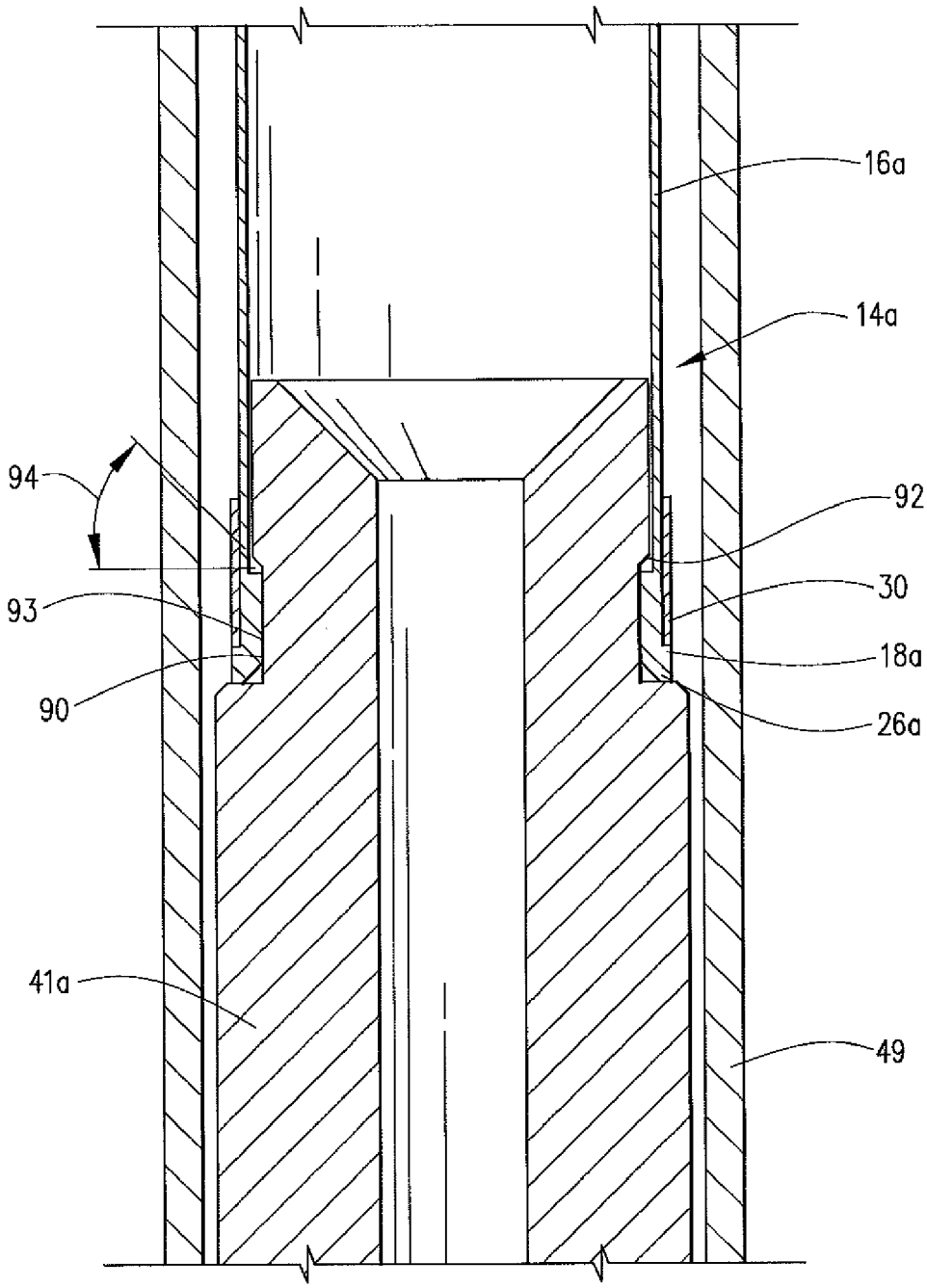
FIG. 5 is a section view of an alternate embodiment of the present invention.

In FIG. 5, an alternate embodiment is depicted in which the mandrel, which may be referred to as mandrel 41*a* has a retaining groove 90 for receiving collet heads 18*a* and has no buttress threads thereon. Mandrel 41*a* may be identical in all other respects to mandrel 41. An end of groove 90 comprises an upper shoulder 92 that angles outwardly from a surface 93 of groove 90. Angle 94 is preferably about 45°, and may be, for example, 30° to 60°. In the embodiment of FIG. 5, the collet, which may be referred to as collet 14*a* has collet heads 18*a* and no threads on collet fingers 16*a*. Collet heads 18*a* will move over shoulder 92 upon the application of the releasing force. Shoulder 92 slidably translates the upwardly directed force applied to the collet 14*a* into a radially directed force against the shear band 30. In the embodiment of FIG. 5, only upper shoulder 92 is angled. If needed, collet heads 18*a* may be angled on the upper ends thereof. The operation of the embodiment of FIG. 5 is identical to that described herein. In other words, collet 14*a* will be kept in engagement with mandrel 41*a* by the shear band 30 until an axial releasing force is applied. The releasing force will cause the radial expansion of collet fingers 16*a* due to the interaction of collet heads 18*a* with mandrel 41*a*, which will break shear band 30 and release mandrel 41*a* from collet 14*a*.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A packer releasing mechanism, comprising:

a collet having a plurality of collet fingers for engaging a mandrel of the packer; and a retaining band circumferentially disposed about the collet fingers for maintaining the collet in an engaged position with respect to the mandrel, the collet being releasable from the mandrel upon application of an axially directed force of a predetermined magnitude applied to the collet, wherein the retaining band is a shear band frangible upon application of the axially directed force of predetermined magnitude which causes the collet to expand radially outward; wherein the axially directed force of predetermined magnitude applied to the collet is sufficient to move the packer to a set position.

2. The apparatus of claim 1 wherein:

each collet finger has a collet head; and the mandrel has a retaining groove defined in an outer surface thereof for receiving the collet heads.

3. The apparatus of claim 2 wherein an upper shoulder of the mandrel retaining groove is angled for slidably translating the axially directed force applied to the collet into a radially directed force against the retaining band.

4. The apparatus of claim 1 wherein the mandrel has buttress threads defined thereon and the collet fingers engage the buttress threads, the buttress threads being capable of translating the axially directed force applied to the collet into a radially directed force on the retaining band.

5. The apparatus of claim 4 wherein the buttress threads have clearance flank angles that are at least 45°.

6. The apparatus of claim 4 wherein the buttress threads have pressure flank angles that are less than 7°.

7. The apparatus of claim 4 wherein the buttress threads have clearance flank angles of about 70° and pressure flank angles of about 5°.

8. The apparatus of claim 4 wherein the ratio of thread height to thread pitch of the buttress threads is less than 1:2.

9. The apparatus of claim 4 wherein the ratio of thread height to thread pitch of the buttress threads is about 1:4.

10. A releasing assembly releasably connected to a packer comprising:

a setting sleeve engageable with a setting tool;

an adapter engageable with the setting tool and releasably connected to a mandrel of the packer; and a retaining band disposed about the adapter for maintaining the connection between the adapter and the mandrel until a setting force is applied to the packer and wherein the retaining band permits the adapter to release the mandrel in response to application of the setting force which causes the adapter to expand radially outward; wherein the setting force of predetermined magnitude applied to the adapter is sufficient to move the packer to a set position.

11. The releasing assembly of claim 10 wherein the adapter is a collet having a plurality of collet fingers releasably connected to the mandrel of the packer.

12. The releasing assembly of claim 11 wherein the retaining band is a shear band disposed about the collet fingers.

13. The releasing assembly of claim 11 wherein the retaining band is disposed about the collet fingers and is at least partially elastomeric.

14. The releasing assembly of claim 11 wherein the mandrel has at least one groove defined thereon for receiving collet heads disposed on the ends of the collet fingers.

15. The releasing assembly of claim 14 wherein the at least one groove is a buttress thread.

16. The releasing assembly of claim 15 wherein the at least one buttress thread has a clearance flank angle of about 70°, a pressure flank angle of about 5° and a thread height to thread pitch ratio of about 1:4.

17. Apparatus for setting a packer in a well comprising:

a setting sleeve;

a collet disposed within the setting sleeve, the collet comprising:

a plurality of collet fingers extending from a collet body; and collet heads at the lower ends of the collet fingers, wherein the collet heads are adapted to engage a mandrel of the packer; and a retaining band disposed about the collet fingers for maintaining engagement of the collet and the mandrel until the application of an axial releasing force is applied to the collet that is at least equal to a setting force needed to move the packer from an unset to a set position and wherein the retaining band permits the adapter to release the mandrel in response to application of the axial releasing force which causes the collet to expand radially outward; wherein the axial releasing force of predetermined magnitude applied to the collet is sufficient to move the packer to a set position.

18. The apparatus of claim 17, wherein the mandrel and collet fingers are adapted to engage such that the axial releasing force applied to the collet is slidably translated into a radially directed force against the retaining band so that the retaining band will break upon application of the axial releasing force.

19. The apparatus of claim 17, further comprising a groove defined in the mandrel, the collet heads being received in the grooves, wherein the axial releasing force moves the collet heads into engagement with a shoulder of the groove to radially expand the collet fingers to apply a radially outwardly directed force to the retaining band.

20. The apparatus of claim 17, further comprising buttress threads defined on the mandrel, wherein the axial releasing force moves the collet fingers along the buttress threads to radially expand the collet fingers and apply a radially outwardly directed force to the retaining band.

* * * * *